US009387976B2

(12) United States Patent
Geis et al.

(10) Patent No.: US 9,387,976 B2
(45) Date of Patent: Jul. 12, 2016

(54) CARRIER ASSEMBLIES FOR PORTABLE DISPENSERS

(75) Inventors: Mark W. Geis, Oak Creek, WI (US); Donald J. Schumacher, Racine, WI (US); Damien Vizcarra, Pasadena, CA (US); Alexandre Hennen, Santa Monica, CA (US)

(73) Assignee: S.C. Johnson & Son, Inc., Racine, WI (US)

( * ) Notice: Subject to any disclaimer, the term of this patent is extended or adjusted under 35 U.S.C. 154(b) by 360 days.

(21) Appl. No.: 13/570,643

(22) Filed: Aug. 9, 2012

(65) Prior Publication Data

US 2014/0042195 A1 Feb. 13, 2014

(51) Int. Cl.

| | |
|---|---|
| ***A45F 5/00*** | (2006.01) |
| ***B65D 41/16*** | (2006.01) |
| ***B65D 83/38*** | (2006.01) |
| ***B65D 83/40*** | (2006.01) |

(52) U.S. Cl.

CPC ..... *B65D 83/388* (2013.01); *B65D 83/384* (2013.01); *B65D 83/40* (2013.01)

(58) Field of Classification Search

CPC ..... B65D 343/06; B65D 343/08; B65D 343/0204; B65D 2543/00648

USPC ..... 224/148.4, 148.7; 220/4.01, 4.21, 4.22, 220/212, 212.5, 253, 786

See application file for complete search history.

(56) References Cited

U.S. PATENT DOCUMENTS

| | | | | |
|---|---|---|---|---|
| 4,371,087 | A * | 2/1983 | Saujet | 215/12.1 |
| 4,620,426 | A * | 11/1986 | Pitchford et al. | 62/457.5 |
| 4,746,008 | A * | 5/1988 | Heverly et al. | 206/1.5 |
| 5,299,700 | A * | 4/1994 | Beniacar | 215/12.1 |
| 5,302,302 | A * | 4/1994 | Shelley et al. | 224/148.4 |
| 5,310,086 | A | 5/1994 | Julinot | |
| 5,348,193 | A | 9/1994 | Bruckner et al. | |
| 5,417,339 | A * | 5/1995 | Liu | 220/315 |
| 5,443,192 | A | 8/1995 | Hodges et al. | |
| 5,779,101 | A * | 7/1998 | Holmgren et al. | 222/130 |
| 6,283,334 | B1 * | 9/2001 | Mahaffey et al. | 222/175 |
| 6,481,590 | B1 * | 11/2002 | Simkins | 215/399 |
| 6,644,513 | B1 * | 11/2003 | Nesbitt | 222/175 |
| 7,178,696 | B2 | 2/2007 | Larsen et al. | |
| 7,637,394 | B2 * | 12/2009 | Grant | 222/182 |
| 7,766,168 | B2 | 8/2010 | Thrapp et al. | |
| 7,854,357 | B2 * | 12/2010 | Hill | 222/475 |

(Continued)

FOREIGN PATENT DOCUMENTS

DE 20319118 U1 4/2005

OTHER PUBLICATIONS

A 2011 photograph of a Repel portable insect lotion repellent dispenser, admitted prior art.

(Continued)

*Primary Examiner* — Nathan J Newhouse
*Assistant Examiner* — Jennifer N Zettl

(57) ABSTRACT

A carrier assembly facilitates the carrying (e.g. by a hiker) of a dispenser for materials such as insect repellents. There are two housings that couple together to form a sealed vault for storing the dispenser between uses. There is also a connector section of one housing in the form of a clip for mounting the housing structure on a backpack or belt loop. A sealing sleeve and a locking sleeve cooperate with the vault to achieve quick opening of the housing parts when desired, without compromising sealing between openings of the vault.

19 Claims, 7 Drawing Sheets

(56) References Cited

U.S. PATENT DOCUMENTS

| | | | | |
|---|---|---|---|---|
| 8,215,511 | B1 * | 7/2012 | Lin | 220/212.5 |
| 8,245,864 | B2 * | 8/2012 | Garland | 220/252 |
| 8,297,462 | B1 * | 10/2012 | Joyce | 220/254.5 |
| 8,448,814 | B2 * | 5/2013 | Yamamoto et al. | 220/788 |
| 8,544,664 | B2 * | 10/2013 | Dejonge | 215/219 |
| 8,973,788 | B1 * | 3/2015 | Burns | 222/175 |
| 2005/0017004 | A1 * | 1/2005 | Schlatter | 220/212 |
| 2005/0274860 | A1 | 12/2005 | Kunesh et al. | |
| 2007/0095838 | A1 * | 5/2007 | Roesler | 220/326 |
| 2008/0078787 | A1 | 4/2008 | Yelland | |
| 2008/0283539 | A1 * | 11/2008 | Salice | 220/838 |
| 2009/0008411 | A1 * | 1/2009 | Schumacher et al. | 222/175 |
| 2009/0236357 | A1 * | 9/2009 | Giraud et al. | 220/849 |

OTHER PUBLICATIONS

PCT/US2013/054295 International Search Report and Written Opinion dated Jan. 22, 2014.

* cited by examiner

CARRIER ASSEMBLIES FOR PORTABLE DISPENSERS

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to assemblies for carrying portable dispensers (e.g. aerosol spray cans containing mosquito repellent).

Portable dispensers have been used to deliver a variety of chemicals to human skin and other surfaces to be treated. Among these chemicals are pest control materials (e.g. insect repellants such as DEET), perfumes, deodorants, and skin protectors (e.g. sunscreen). Many of these dispensers are typically stored in a home, and then applied in the home shortly before one goes outdoors (with the dispenser then being left in the home). However, during some outdoor activities (e.g. hiking, camping, sailing) it is sometimes desirable to apply/reapply certain of these chemicals.

Carrying conventional dispensers outdoors can sometimes be problematic. For example, protecting the dispensers from environmental water can require undesirably bulky/heavy structures, and/or structures that make it difficult to obtain access to the dispenser once stored. Further, protecting items in backpacks from leakage from these dispensers is a concern if the dispensers are placed in the backpacks. In any event, some of these dispensers are quite bulky.

U.S. Pat. No. 5,348,193 disclosed a system for carrying an aerosol can using a clip-on system. However, the means of installing and accessing the aerosol can was awkward.

U.S. Pat. No. 7,178,696 disclosed another portable clip-on sprayer system. However, in this type of system the spray was delivered through an upper mounting clip. The clip could become coated with active from use.

Further complicating matters, it is preferred that the useful life of a carrying system for such containers not be limited to the useful life of the container (to avoid the waste and cost involved if the carrying system also needs to be replaced with each empty container).

Hence, improvements are needed with respect to carriers for such portable dispensers.

BRIEF SUMMARY OF THE INVENTION

In one aspect the invention provides an assembly for removably carrying a dispenser. The assembly has an upper housing having an internal cavity, a connector section and a downwardly depending skirt. There is also a lower housing that has an internal cavity and a groove adjacent the lower housing's upper end, the lower housing's internal cavity being suitable to receive and carry a dispenser (such as an aerosol spray can) when the dispenser is inserted therein.

The assembly also has a sealing sleeve positionable partially inside the skirt with a lower sealing ring portion thereof extending outwardly there from, and a locking sleeve positioned in the upper housing's internal cavity, but with a lower foot thereof being radially inwardly movable in response to pressing force being applied to the assembly.

If the lower foot is positioned in, and thereby coupled to, the lower housing's groove, the lower housing is thereby held together with the upper housing. If thereafter the pressing force is applied the foot is decoupled from the groove, thereby permitting the lower housing to be decoupled from the upper housing, and thereby permitting access to the lower housing's internal cavity.

The connector section of the upper housing is preferably a clip. A particularly desirable form of clip is a carabineer type spring clip as this enables a very quick, secure attachment to a backpack or belt loop.

The assembly permits such a container to be stored inside the internal cavities of the housings in a manner such that it is protected from outside water (e.g. rain water, bilge water in a boat, lake water). The assembly also protects the belongings of the person carrying the container from any undesired contact between chemicals in the container and sensitive items also being carried (as the sealed vault that is formed by the housings and sealing sleeve also precludes any leakage from the container reaching whatever is near the area where the lower housing is hung).

The upper housing preferably clips onto a belt loop or backpack loop that is being carried by the consumer. When a refreshed application of the chemical is desired (e.g. more sunscreen is to be applied after a prolonged hike), the consumer can (with this preferred embodiment) squeeze the upper assembly.

The locking sleeve and sealing sleeve may have corresponding alignment tabs (e.g. contoured triangular tabs) to properly align those two parts with respect to each other, and (given apertures along the sides of the upper housing that are aligned with those tabs as well) also to indicate to a consumer where to squeeze.

The locking sleeve preferably has two axial slots that are spaced from each other to form a flexible leg, the foot forming a lower portion of the leg. Squeezing the upper assembly deflects the foot (and leg) inwardly, thereby permitting the lower housing (preferably in the form of a cylindrical cup) to be decoupled from the upper housing while the upper housing remains attached to the backpack or other clothing item. There may be two such legs and feet, at opposed portions of the skirt.

The invention can alternatively provide an assembly for removably carrying a dispenser. This assembly has an upper housing having an internal cavity, a connector section and a downwardly depending skirt; a lower housing that has an internal cavity suitable to receive and carry the dispenser if the dispenser is inserted therein; a sealing sleeve positioned partially inside the skirt with a lower sealing ring portion thereof extending outward there from; and a locking sleeve positioned in the upper housing's internal cavity. The locking sleeve and lower housing can be coupled together thereby also coupling the lower housing to the upper housing (and thereafter easily decoupled if access to the dispenser is desired).

Various embodiments of the present invention may have one or more advantages. For example, the assembly may permit insect sprays, sunscreens and other chemicals that are to be applied outdoors to have their dispensers conveniently carried in a hands free manner (e.g. by a hiker). These dispensers can be accessed quite easily, and then restored after application (without the hiker, jogger or the like needing to interrupt their main activity). The dispenser is protected during storage from environmental water, and the consumer's belongings are protected from leakage between uses.

When a particular spray can or other dispenser is used up, the consumer can dispose of the container and replace it with a refill. However, the remainder of the carrier assembly can be reused many times, with many refill canisters. This lowers the overall cost of using the system (as the main carrier assembly parts need not be purchased again with each refill can).

Moreover, the parts of the carrier assembly are inexpensive to produce and intuitive to assemble and use. Further, they can easily be made of materials that are well suited for outdoor use.

The foregoing and other advantages of the present invention will be apparent from the following description of the preferred embodiments. As these embodiments are merely illustrative, they are not intended to represent the full scope of the invention. Thus, reference should therefore be made to the claims herein for interpreting the scope of the invention.

DETAILED DESCRIPTION OF THE PREFERRED EMBODIMENTS

In a first preferred embodiment, carrier assembly 10 is shown adjacent a refill container 11. Container 11 may deliver a mosquito repellent formulation such as a somewhat concentrated DEET formulation (e.g. 30 percent DEET). It can instead deliver other materials such as insecticide, or skin treatment materials such as sunscreen, perfume, a deodorant, or a sanitizer. As an example, the container could be filled with an insecticide to be sprayed around a tent entry flap when the tent is erected.

Figure 2A:
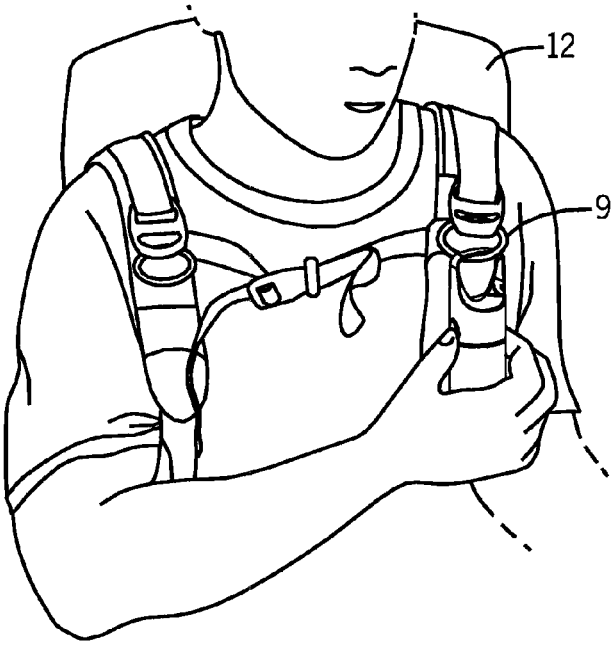
FIG. 2A depicts that carrier assembly, albeit shown hung from a backpack and in the process of having its lower housing disconnected from its upper housing.
Figure 2B:
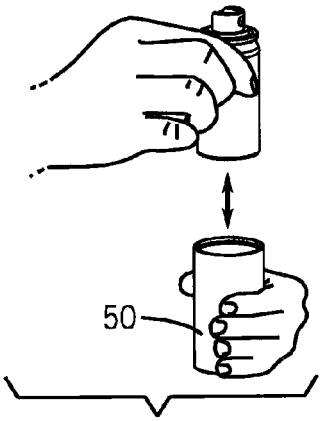
FIG. 2B shows how the lower housing of FIG. 2A can be used to store a spray can between uses.
Figure 2C:
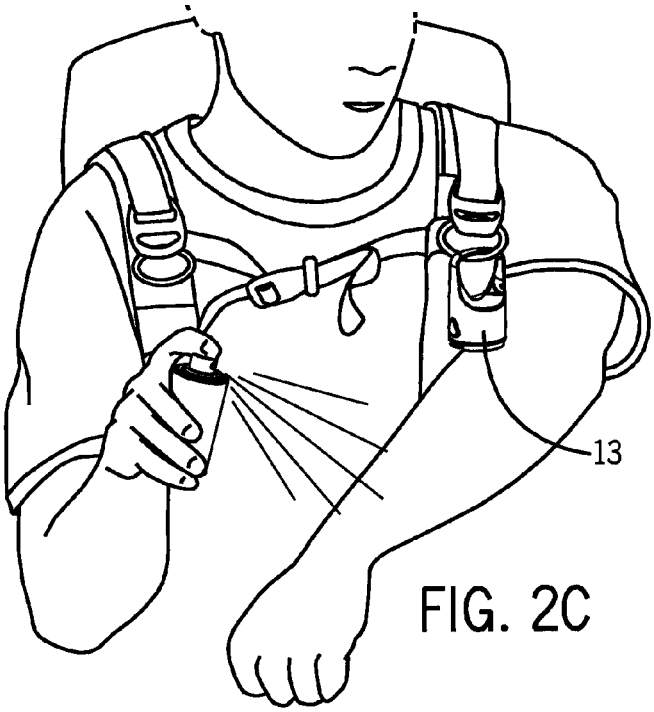
FIG. 2C depicts how the spray can of FIG. 2B can be used to spray repellent on a human arm while the upper mounting structure remains attached to the backpack.
Figure 3:
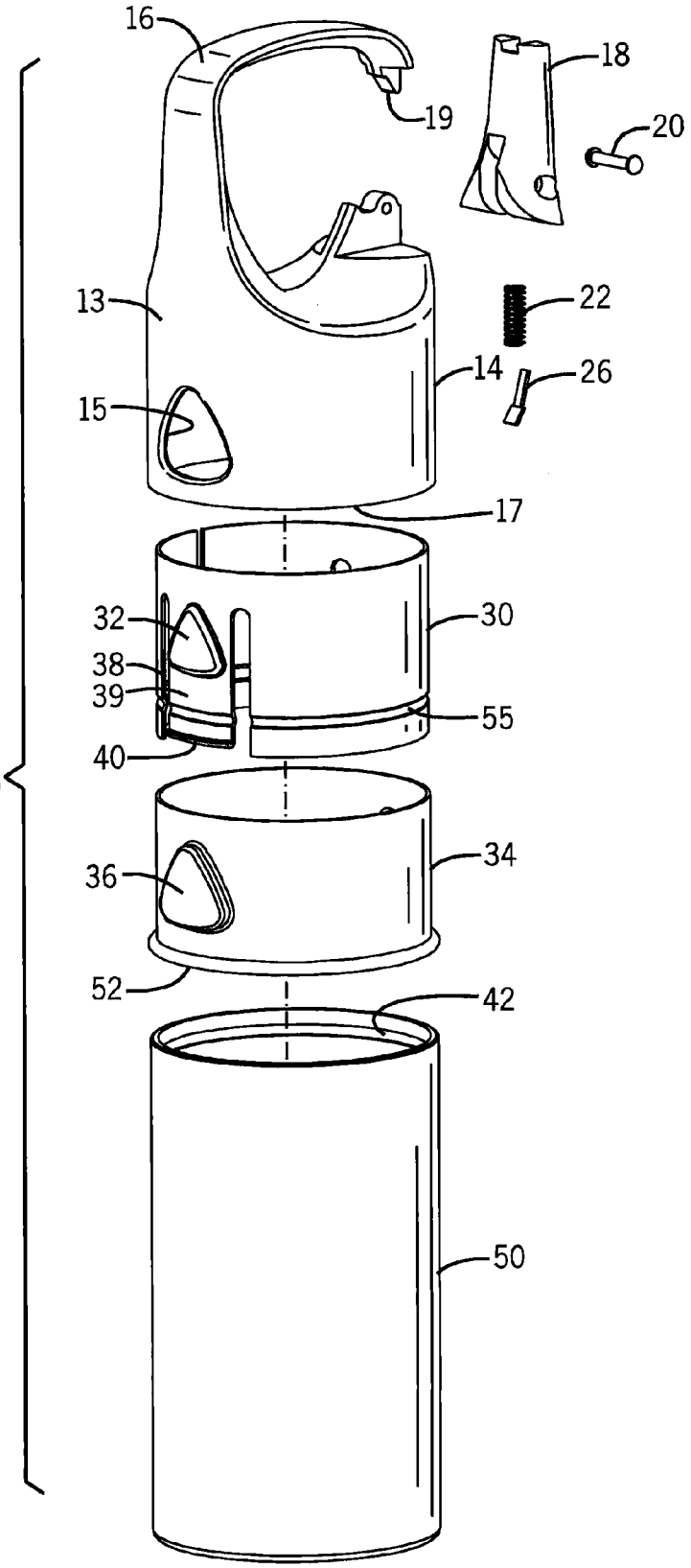
FIG. 3 is an exploded (and partially disassembled) view of the FIG. 1 carrier assembly (without spray can)
Figure 3A:
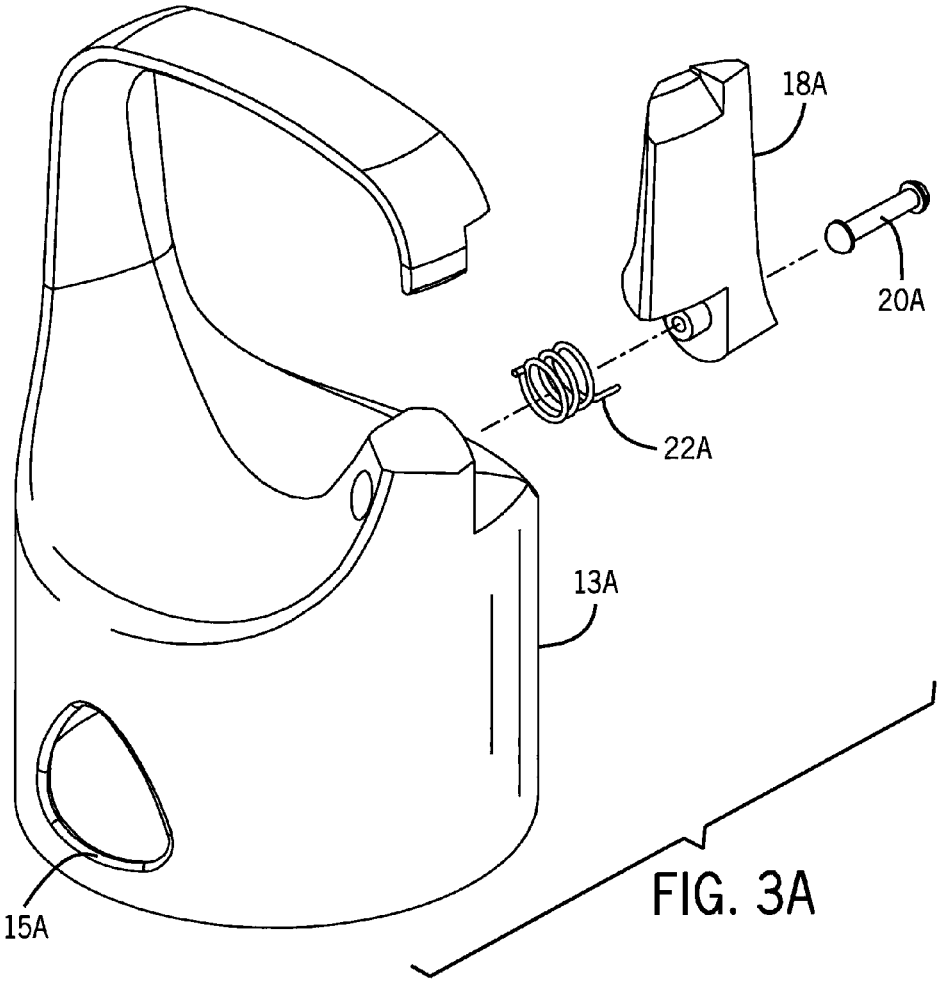
FIG. 3A depicts a second embodiment that is similar to the first, except that the openings 15A are now at twelve o'clock and six o'clock positions rather than three o'clock and nine o'clock positions, and the spring clip specifics 18A/20A/22A are slightly altered.
Figure 3B:
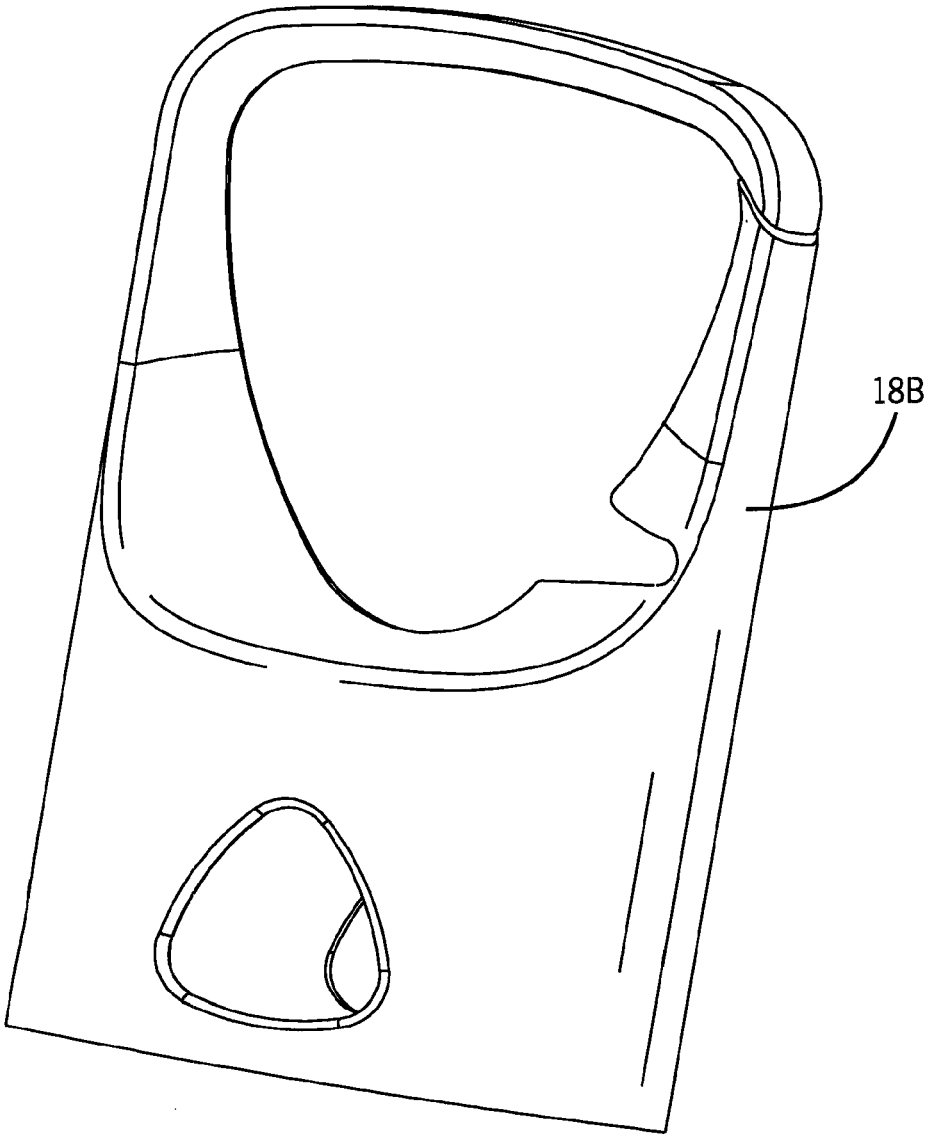
FIG. 3B is a third embodiment where the spring latch part 18B is now an integrated plastic element.
Figure 4:
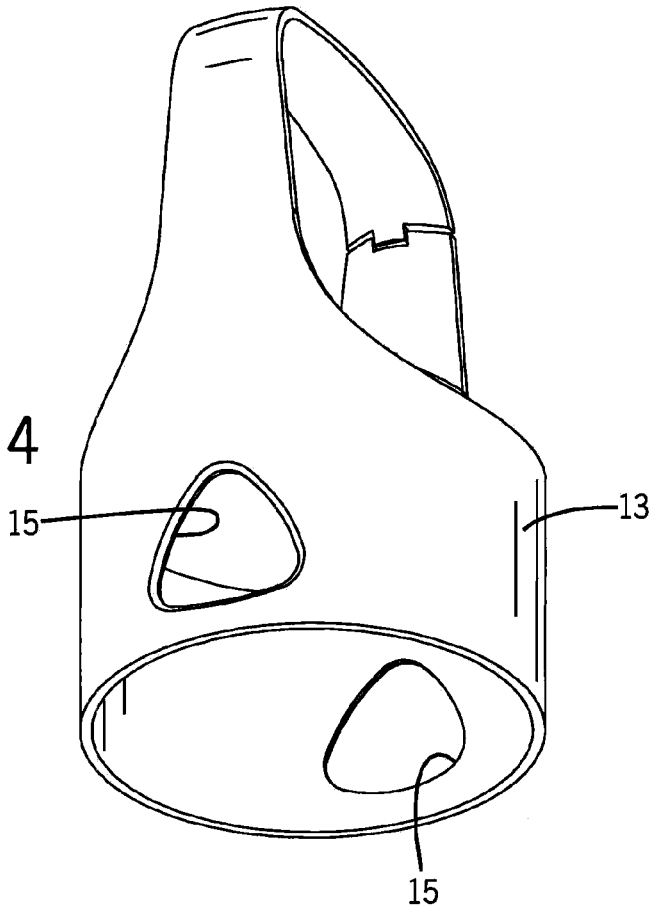
FIG. 4 is a lower perspective view of the upper housing of the FIG. 1 assembly.

As best illustrated in FIGS. 2A-2C, carrier assembly 10 can be clipped onto a loop of an item carried by a human (e.g. loop 9 of backpack 12, a belt loop, lanyard, or other clothing structure having a loop).

Upper housing 13 of the carrier assembly has a lower skirt 14 and an upper connector structure 16. Near the bottom of the skirt 14 is an aperture 15. In a preferred form there may be one such aperture 15 on each of two opposed sides of the skirt.

Figure 1:
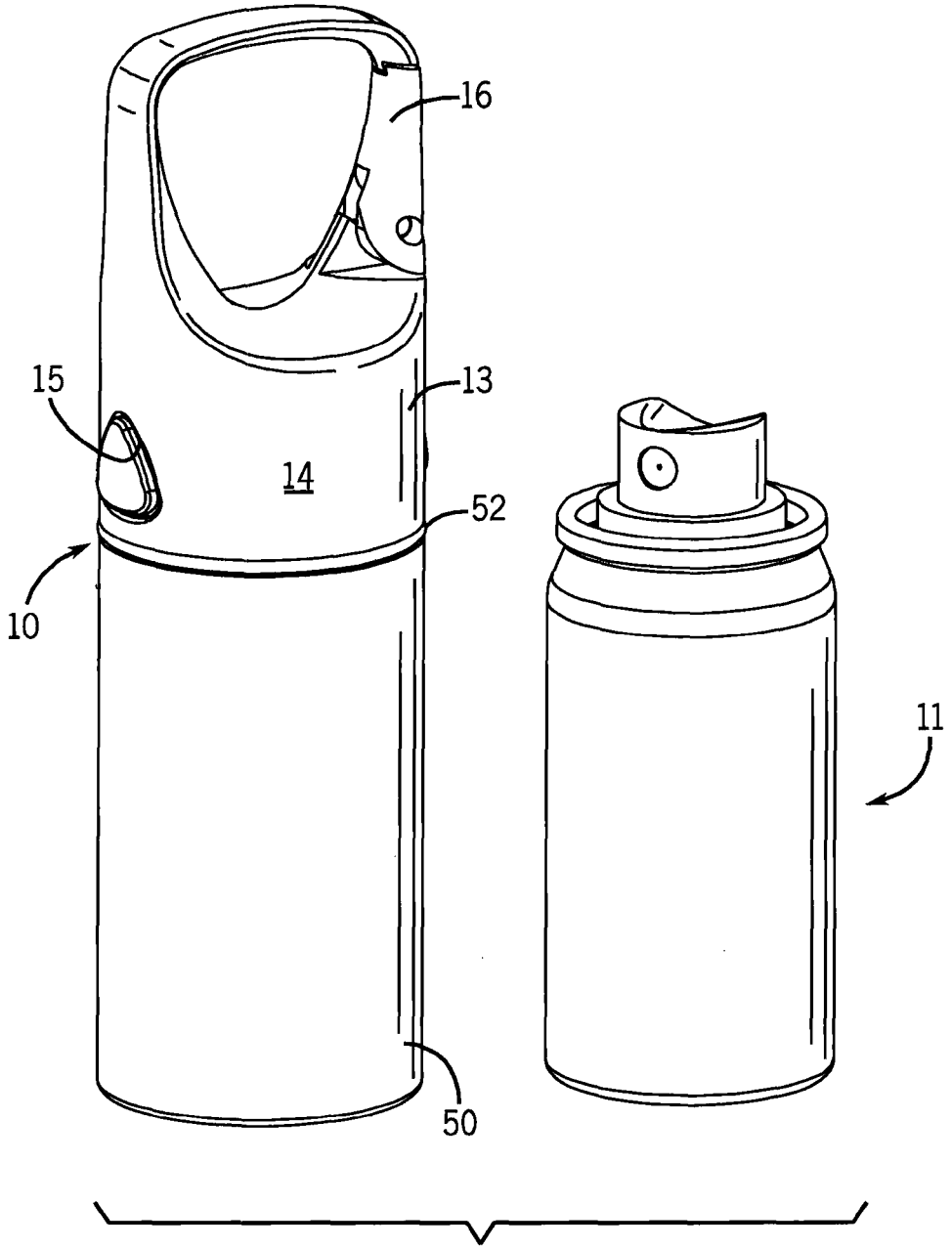
FIG. 1 is a perspective view of a carrier assembly of the present invention, shown adjacent a refill spray can.

The clip has a latch part 18 that pivots on rivet 20, from the FIG. 1 closed position to an open position. The open position allows the clip structure to attach the carrier assembly to the backpack loop 9. Note that there is a spring 22 and a spring tab 24 which together serve to bias the latch part 18 to the closed position. Thus, a finger can push the latch part 18 open, the freed end 19 of the clip can be hooked through the backpack or other loop, and the latch can then automatically spring back to the FIG. 1 position once finger pressure is released. This type of clip is known as a "carabineer" type clip.

Figure 5:
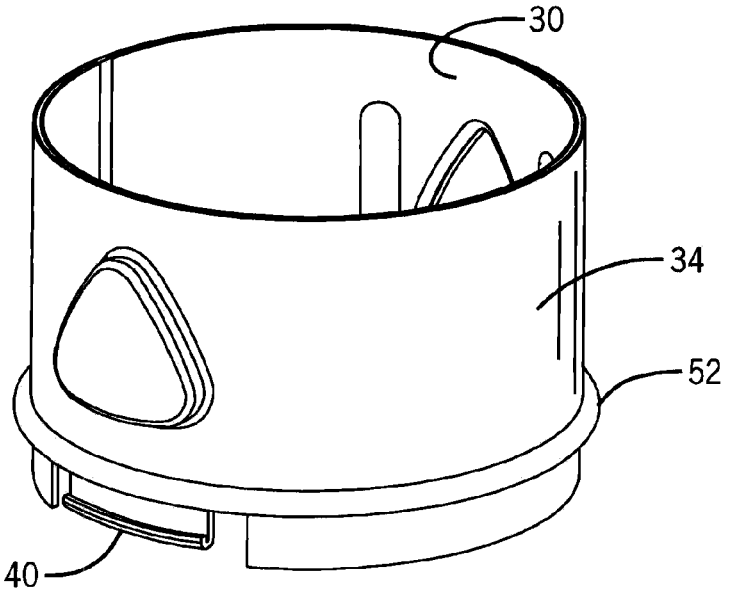
FIG. 5 is an upper perspective view of a subassembly of the sealing sleeve and locking sleeve of the present invention.
Figure 6:
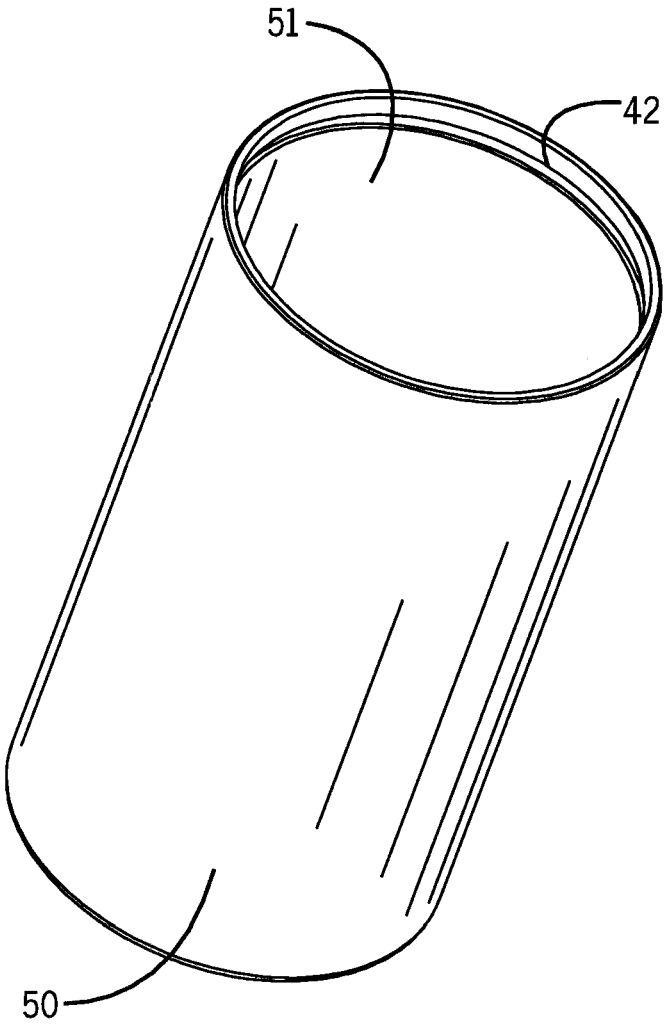
FIG. 6 depicts a top perspective view of the lower housing's upper portion.

Positionable mostly within internal cavity 17 of skirt 14 is a latching sleeve 30 made of spring steel. At least one region 32 (preferably two opposed regions 32) of that sleeve readily flex inwardly in response to radial force. There is also a sealing sleeve 34 (made of gasket material) that generally fits outside latching sleeve 30 (see FIG. 5), albeit mostly inside skirt 14, with at least one region 36 (preferably two opposed regions 36) aligned with regions 32. Regions 32 and 36 are all contoured triangular and form alignment tabs, and these in turn align with apertures 15 so that regions 36 project there through.

When the parts are assembled, one can squeeze region(s) 36 (through apertures 15) so that they also deflect region(s) 32. The effect on region(s) 32 is enhanced because of axial slots 38. This squeezing decouples foot 40 on at least one leg 39 from an attachment groove 42 formed along an inside wall of cup-shaped lower housing 50, and thereby permits the lower housing 50 to be separated from the upper housing. When the sealing sleeve 34 is positioned as in FIG. 1, bead 52 sits in groove 55 of the latching sleeve 30, and also seals between a bottom edge of the upper housing 13 and a top edge of the lower housing 50, thereby creating a sealed "vault" for the container 11.

The overall assembly therefore provides a quick release connection. The lower housing 50 can be quickly detached from the upper mounting structure (see especially FIG. 2C). The spray can may then be accessed as indicated by FIG. 2B and used as indicated in FIG. 2C. When the spray can is used up, it can be thrown away. A refill container 11 can then be used in its place.

In one possible intended use a hiker may clip the assembly 10 onto a backpack 12 at a loop 9. When the hiker wishes to refresh insect protection (e.g. after a few hours of a hike), the hiker squeezes the assembly while pulling lower housing 50 down (see FIG. 2A). This disconnects the lower housing/aerosol can.

As shown in FIG. 2B, the can may then be removed from the lower housing 50, and the aerosol chemical may then be sprayed as shown in FIG. 2C. If the can then still has active left, the can may then be re-inserted into the lower housing 50, with the lower housing then being re-connected to the upper housing by pushing foot/feet 40 into groove 42. Alternatively, as shown in FIG. 1, the can 11 can be sized relative to the lower housing 50 so that even when in the lower housing the upper nozzle will project out of the lower housing. Thus, the spray may be applied in this embodiment even without removing the can from the lower housing (with the can only being removed when being replaced with another refill).

While the above describes preferred embodiments, it should be appreciated that other embodiments are also within the scope of the invention. For example, the active container may be a pump sprayer or squeeze tube rather than an aerosol can, and the mounting connector may be another type of connector besides a clip, or even still other types of carabineer clips besides the three shown.

As another modification, there could be a foam sleeve positioned within the internal cavity 51 of lower housing 50. This would reduce rattling noise if a metal aerosol canister is positioned in the cup-shaped lower housing 50 and the human is highly active (e.g. if the assembly is used by a jogger).

As yet another modification, the lower housing may have the flexible projection, and the latching sleeve may have the receiving groove. This and other recess and projection constructions are intended.

Moreover, the latching sleeve may connect to the lower housing via other attachment techniques. For example, there could be a threaded connection or a quarter turn bayonet connection.

Regardless, the invention is not to be limited to just the specific embodiments shown or described, and the following claims should therefore be looked to in order to judge the full scope of the invention.

INDUSTRIAL APPLICABILITY

There are disclosed assemblies for facilitating the carrying of dispensers outdoors, while allowing the dispenser to be readily accessed when needed, but stored in a sealed vault between uses.

All documents cited in this patent are, in relevant part, incorporated herein by reference. The citation of any document is not to be construed as an admission that it is prior art with respect to the present invention.

What is claimed is:

1. An assembly for removably carrying a dispenser, the assembly comprising:

an upper housing having an internal cavity, a connector section and a downwardly depending skirt;

a lower housing that has an internal cavity and a groove formed aroundan entire perimeter of an inner surface of the lower housing adjacent the lower housing's upper end, the lower housing's internal cavity being suitable to receive and carry the dispenser if the dispenser is inserted therein;

a sealing sleeve positioned partially inside the skirt, the sealing sleeve having a lower sealing ring portion extending outwardly along a perimeter of a lower edge of the upper housing; and a latching sleeve positioned within the sealing sleeve within the upper housing's internal cavity, and with at least one lower foot being radially inwardly movable in response to pressing force being applied to the assembly;

wherein if the lower foot is positioned in, and thereby coupled to, the lower housing's groove, the lower housing can thereby be held together with the upper housing; and wherein if thereafter said pressing force is applied the foot can be decoupled from the groove, thereby facilitating the lower housing being decoupled from the upper housing, and thereby permitting access to the lower housing's internal cavity.

2. The assembly of claim 1, further comprising the dispenser.

3. The assembly of claim 2, wherein the dispenser is positioned in the lower housing's internal cavity.

4. The assembly of claim 2, wherein the dispenser is selected from the group consisting of aerosol spray containers and pump spray containers.

5. The assembly of claim 4, wherein the dispenser contains an insect control ingredient.

6. The assembly of claim 1, wherein the connector section comprises a clip.

7. The assembly of claim 6, wherein the clip has been mounted on a loop that is an item selected from the group consisting of a belt loop, a backpack loop and a lanyard loop.

8. The assembly of claim 1, wherein the latching sleeve and sealing sleeve have corresponding alignment tabs to align those two parts with respect to each other.

9. The assembly of claim 3, wherein the upper housing and lower housing can be coupled together to have their internal cavities together form an essentially fluid tight internal vault for the dispenser.

10. The assembly of claim 1, wherein the latching sleeve comprises two axial slots that are spaced apart to form a flexible leg, the foot extending from a lower portion of the leg.

11. An assembly for removably carrying a dispenser, the assembly comprising:

an upper housing having an internal cavity, a connector section and a downwardly depending skirt;

a lower housing that has an internal cavity suitable to receive and carry the dispenser if the dispenser is inserted therein;

a sealing sleeve positioned partially inside the skirt, the sealing sleeve having a lower sealing ring portion extending outwardly along a perimeter of a lower edge of the upper housing; and a latching sleeve including a groove located proximate a lower end and about the entire perimeter of the latching sleeve, wherein the latching sleeve is positioned radially inward within the sealing sleeve in the upper housing's internal cavity;

wherein the latching sleeve and lower housing can be coupled together, thereby coupling the lower housing to the upper housing, and the sealing ring is in communication with the latching sleeve groove, the lower perimeter edge of the upper housing, and an upper perimeter edge of the lower housing when the upper housing is coupled to the lower housing.

12. The assembly of claim 6, wherein the clip includes a spring and a rotatable latch.

13. The assembly of claim 12, wherein the latch is biased by the spring into a closed position and rotating the latch toward a central axis of the upper housing defines an open position.

14. The assembly of claim 13, wherein the clip further includes an arm having a free end, wherein a distal end of the latch and the free end of the arm are in contact when the clip is in a closed position.

15. The assembly of claim 1, wherein the at least one lower foot is contained completely within the lower housing when the at least one lower foot is positioned in the lower housing groove.

16. An assembly for removably carrying a dispenser, the assembly comprising:

an upper housing having an internal cavity, a connector section and a downwardly depending skirt;

a lower housing that has an internal cavity and a groove adjacent the lower housing's upper end, the lower housing's internal cavity being suitable to receive and carry the dispenser if the dispenser is inserted therein;

a sealing sleeve positioned partially inside the skirt, the sealing sleeve having a lower sealing ring portion extending outwardly along a perimeter of a lower edge of the upper housing; and a latching sleeve positioned within the sealing sleeve within the upper housing's internal cavity, and with at least one lower foot being radially inwardly movable in response to pressing force being applied to the assembly, wherein if the lower foot is positioned in, and thereby coupled to, the lower housing's groove, the lower housing can thereby be held together with the upper housing, wherein if thereafter said pressing force is applied the foot can be decoupled from the groove, thereby facilitating the lower housing being decoupled from the upper housing, and thereby permitting access to the lower housing's internal cavity, wherein the groove adjacent the upper end of the lower housing is disposed on a inner surface of the lower housing, wherein the at least one lower foot is contained completely within the lower housing when the at least one lower foot is positioned in the lower housing groove, and wherein the upper housing further includes at least one aperture, the sealing sleeve further includes at least one projection region, and the latching sleeve includes at least one pressing projection, and wherein the at least one projection region and the at least one pressing projection are configured to extend into the at least one aperture of the upper housing.

17. The assembly of claim 16, wherein the at least one pressing projection is disposed on an upper portion of at least one leg defined by slots on either side thereof, and the at least one lower foot is disposed proximate a lower end of the at least one leg, and wherein the at least one leg is radially inwardly moveable in response to the pressing force being applied to the pressing projection through the at least one aperture.

18. The assembly of claim 17, wherein the pressing force being applied to each of the at least one pressing projections allows the upper housing to be decoupled from the lower housing.

19. The assembly of claim 1, wherein an outer surface of the sealing sleeve is in communication with an inner surface of the of the depending skirt along the perimeter of the inner surface of the depending skirt and an outer surface of the of the latching sleeve is in communication with an inner surface of the sealing sleeve along the perimeter of the inner surface of the sealing sleeve.

* * * * *